US010401094B2

(12) United States Patent
Taras et al.

(10) Patent No.: US 10,401,094 B2
(45) Date of Patent: Sep. 3, 2019

(54) BRAZED PLATE HEAT EXCHANGER FOR WATER-COOLED HEAT REJECTION IN A REFRIGERATION CYCLE

(75) Inventors: Michael F. Taras, Fayetteville, NY (US); Mark J. Perkovich, Fayetteville, NY (US); Mel Woldesemayat, Liverpool, NY (US)

(73) Assignee: CARRIER CORPORATION, Farmington, CT (US)

( * ) Notice: Subject to any disclaimer, the term of this patent is extended or adjusted under 35 U.S.C. 154(b) by 565 days.

(21) Appl. No.: 13/984,174

(22) PCT Filed: Jan. 31, 2012

(86) PCT No.: PCT/US2012/023334
§ 371 (c)(1),
(2), (4) Date: Aug. 7, 2013

(87) PCT Pub. No.: WO2012/109057
PCT Pub. Date: Aug. 16, 2012

(65) Prior Publication Data

US 2013/0319036 A1 Dec. 5, 2013

Related U.S. Application Data

(60) Provisional application No. 61/440,662, filed on Feb. 8, 2011.

(51) Int. Cl.
*F28F 3/12* (2006.01)
*F25B 1/10* (2006.01)
(Continued)

(52) U.S. Cl.
CPC ..... *F28F 3/12* (2013.01); *F25B 1/10* (2013.01); *F25B 9/008* (2013.01); *F28D 9/005* (2013.01);
(Continued)

(58) Field of Classification Search
CPC ..... F25B 1/10; F25B 9/008; F25B 31/006; F25B 39/04; F25B 2309/061;
(Continued)

(56) References Cited

U.S. PATENT DOCUMENTS 5,717,609 A 2/1998 Packa et al.
5,931,219 A 8/1999 Kull et al.
(Continued)

FOREIGN PATENT DOCUMENTS

CN 1399117 2/2003
CN 101371085 A 2/2009
(Continued)

OTHER PUBLICATIONS

Search Report issued in Singapore Applicaiton No. 2013059282; dated May 5, 2015; 5 pages.
(Continued)

*Primary Examiner* — Christopher R Zerphey
(74) *Attorney, Agent, or Firm* — Cantor Colburn LLP

(57) ABSTRACT

A water-cooled heat rejection heat exchanger is provided and includes a housing having first and second opposing end plates and sidewalls extending between the end plates to form an enclosure, at least the first end plate including first and second inlet/outlet pairs for first and second fluids, respectively, a plurality of plates disposed within the enclosure between the first and second end plates to define a first fluid pathway disposed in fluid communication with the first inlet/outlet pair and a second fluid pathway disposed in fluid communication with the second inlet/outlet pair and a plurality of brazed formations disposed between adjacent ones of the first end plate, the plurality of plates and the second end plate to isolate the first fluid pathway from the second fluid pathway.

19 Claims, 4 Drawing Sheets

(51) Int. Cl.

| | |
|---|---|
| ***F25B 9/00*** | (2006.01) |
| ***F28D 9/00*** | (2006.01) |
| ***F28F 21/08*** | (2006.01) |
| *F28D 21/00* | (2006.01) |

(52) U.S. Cl.
CPC ..... *F28F 21/083* (2013.01); *F25B 2309/061* (2013.01); *F25B 2339/047* (2013.01); *F25B 2341/0662* (2013.01); *F25B 2400/13* (2013.01); *F25B 2400/23* (2013.01); *F28D 2021/0073* (2013.01); *F28F 2275/04* (2013.01)

(58) Field of Classification Search
CPC ..... F25B 2339/043; F25B 2339/047; F25B 2400/072; F25B 6/04; F25B 2313/072; F28F 3/12; F28F 21/083; F28F 2275/04; F28D 9/005; F28D 2021/0073
See application file for complete search history.

(56) References Cited

U.S. PATENT DOCUMENTS

| | | | | |
|---|---|---|---|---|
| 6,643,567 | B2 | 11/2003 | Kolk et al. | |
| 7,272,180 | B2 | 9/2007 | Dambrackas | |
| 7,567,844 | B2 | 7/2009 | Thomas et al. | |
| 7,774,101 | B2 | 8/2010 | Ballate et al. | |
| 2001/0047861 | A1* | 12/2001 | Maeda et al. | 165/167 |
| 2003/0010488 | A1 | 1/2003 | Watanabe | |
| 2005/0279127 | A1* | 12/2005 | Jia et al. | 62/510 |
| 2006/0010899 | A1* | 1/2006 | Lifson et al. | 62/324.1 |
| 2006/0053833 | A1* | 3/2006 | Martins et al. | 62/507 |
| 2008/0229226 | A1 | 9/2008 | Rowbottom et al. | |
| 2008/0310850 | A1 | 12/2008 | Pederson et al. | |
| 2010/0058248 | A1 | 3/2010 | Park | |
| 2010/0154467 | A1 | 6/2010 | Fujimoto | |
| 2010/0258284 | A1* | 10/2010 | Krantz | 165/166 |
| 2010/0258285 | A1* | 10/2010 | Yao et al. | 165/167 |
| 2010/0258288 | A1* | 10/2010 | Krantz et al. | 165/185 |
| 2010/0274366 | A1 | 10/2010 | Fata et al. | |
| 2010/0274408 | A1 | 10/2010 | Stiles, Jr. et al. | |
| 2010/0286937 | A1 | 11/2010 | Hedley et al. | |
| 2010/0326100 | A1 | 12/2010 | Taras | |
| 2011/0024097 | A1 | 2/2011 | Christensen et al. | |
| 2011/0036110 | A1 | 2/2011 | Fujimoto et al. | |
| 2011/0220337 | A1* | 9/2011 | Munari | 165/181 |
| 2012/0000237 | A1* | 1/2012 | Yamada | F25B 1/10 62/324.6 |

FOREIGN PATENT DOCUMENTS

| | | | |
|---|---|---|---|
| CN | 101936613 | A | 1/2011 |
| FR | 2850740 | A1 | 8/2004 |
| GB | 2218794 | | 11/1989 |
| JP | 2002107074 | | 4/2002 |
| WO | 03019085 | | 3/2003 |
| WO | 2007022777 | | 3/2007 |
| WO | 2007036963 | | 4/2007 |
| WO | 2009105092 | A1 | 8/2009 |
| WO | 2010047650 | A1 | 4/2010 |
| WO | 2011136425 | | 11/2011 |
| WO | 2011139425 | A2 | 11/2011 |

OTHER PUBLICATIONS

Written Opinion issued in Singapore Applicaiton No. 2013059282; dated May 5, 2015; 7 pages.
Chinese Office Action issued in CN Application No. 2012800021777.5; dated Feb. 3, 2015, 4 pages.
International Search Report issued for corresponding application No. PCT/US2012/023334 filed on Jan. 31, 2012, dated Aug. 16, 2012, pp. 1-7.
Written Opinion issued for corresponding application No. PCT/US2012/023334 filed Jan. 31, 2012, dated Aug. 16, 2012, pp. 1-10.
Chinese Office Action issued in Chinese Application No. 201280008177.5 dated Oct. 27, 2015; 3 pages.
Office Action, dated Dec. 20, 2016, Chinese Patent Application No. 201280008177.5, 24 pages.

* cited by examiner

BRAZED PLATE HEAT EXCHANGER FOR WATER-COOLED HEAT REJECTION IN A REFRIGERATION CYCLE

CROSS REFERENCE TO RELATED APPLICATION

This application is a National Stage Application of PCT Application No. PCT/US2012/023334 filed Jan. 31, 2012, which is a PCT Application of U.S. Provisional Application No. 61/440,662 Filed Feb. 8, 2011, the disclosures of which are incorporated by reference herein in their entireties.

BACKGROUND OF THE INVENTION

The subject matter disclosed herein relates to a brazed plate water-cooled gas cooler/condenser.

Container customer demands dictate that container refrigeration units (CRUs) have the capability to reject heat to a water source and the capability to reject heat to the ambient air. This typically happens when the CRUs are on board a ship, where the water-cooled heat rejection heat exchanger is typically positioned in a refrigerant circuit downstream from an air-cooled heat rejection heat exchanger, with respect to a direction of refrigerant flow (although other configurations are also feasible). In these cases, when the unit uses the water-cooled heat rejection heat exchanger as the heat sink, the air-cooled heat rejection heat exchanger is typically rendered inoperable. This is achieved by turning the condenser fan off.

The currently known water-cooled heat rejection heat exchanger design is the shell-and-tube type, with the water on the tube side, and the refrigerant on the shell side. The heat exchanger shell for these units is typically made of carbon steel to contain refrigerant and cupronickel tubes to contain water. Cupronickel is chosen for its excellent resistance to corrosion when exposed to sea water, as sea water in the past has been used as the water source. It has to be understood, that although this configuration is preferred for a number of reasons, refrigerant can be flown inside the tubes and water contained on the shell side. Also, other liquid coolants, such as glycol solutions, can be utilized in place of water. The population of CRUs made with the water-cooled heat rejection heat exchangers is about 20% of the total production volume.

Typically, water-cooled heat rejection heat exchangers of CRUs operate as condensers, where refrigerant flown through the heat rejection heat exchanger is below the critical point and is condensing from vapor to liquid. However, for some refrigerants (such as carbon dioxide), a water-cooled heat rejection heat exchanger may operate as a condenser for a portion of the time, while operating as a gas cooler for another portion of the time. In the latter case, refrigerant flown through the heat rejection heat exchanger is above the critical point and, while cooled by water, is maintained in a single phase. Additionally, the high operating pressures induced by refrigerants such as carbon dioxide require special structural design considerations for the heat rejection heat exchangers. Lastly, other heat exchangers, such as intercoolers positioned between the compression stages, may assist in the heat rejection process.

BRIEF DESCRIPTION OF THE INVENTION

According to one aspect of the invention, a heat rejection heat exchanger is provided and includes a housing having first and second opposing end plates and sidewalls extending between the end plates to form an enclosure, at least the first end plate including first and second inlet/outlet pairs for first and second fluids, respectively, a plurality of plates disposed within the enclosure between the first and second end plates to define a first fluid pathway disposed in fluid communication with the first inlet/outlet pair and a second fluid pathway disposed in fluid communication with the second inlet/outlet pair and a plurality of brazed formations disposed between adjacent ones of the first end plate, the plurality of plates and the second end plate to isolate the first fluid pathway from the second fluid pathway.

According to another aspect of the invention, a heat rejection heat exchanger is provided and includes a housing having first and second opposing end plates and sidewalls extending between the end plates to form an enclosure, at least the first end plate including high and low temperature inlet/outlet pairs for high and low temperature fluids, respectively, a plurality of plates disposed within the enclosure between the first and second end plates to define a high temperature fluid pathway disposed in fluid communication with the high temperature inlet/outlet pair and a low temperature fluid pathway disposed in fluid communication with the low temperature inlet/outlet pair and a plurality of brazed formations disposed between adjacent ones of the first end plate, the plurality of plates and the second end plate to isolate the high temperature fluid pathway from the low temperature fluid pathway.

According to yet another aspect of the invention, a refrigeration unit is provided and includes a vapor compression cycle including an evaporator, an air-cooled heat rejection heat exchanger and a compressor operably disposed between the evaporator and the condenser, and a water-cooled brazed plate heat rejection heat exchanger operably disposed between the compressor and the evaporator receiving high temperature fluid from the compressor and low temperature fluid from an external source, whereby the high temperature fluid is cooled via thermal communication with the low temperature fluid and is flown from the compressor to the evaporator, the water-cooled brazed plate heat rejection heat exchanger being formed to define high and low temperature fluid pathways and including a plurality of brazed formations to isolate the high temperature fluid pathway from the low temperature fluid pathway.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
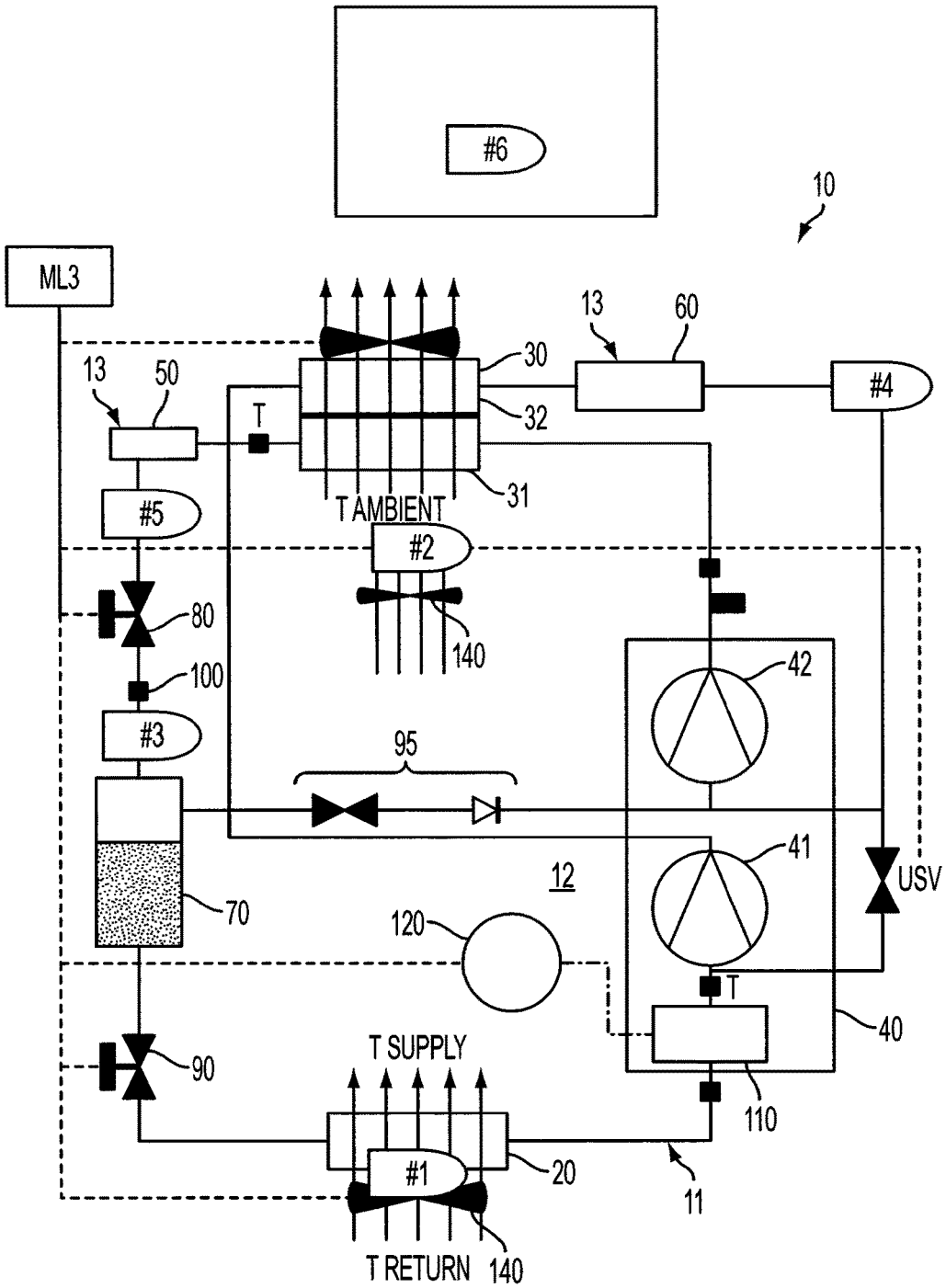
FIG. 1 is a schematic illustration of a refrigeration unit.
Figure 2:
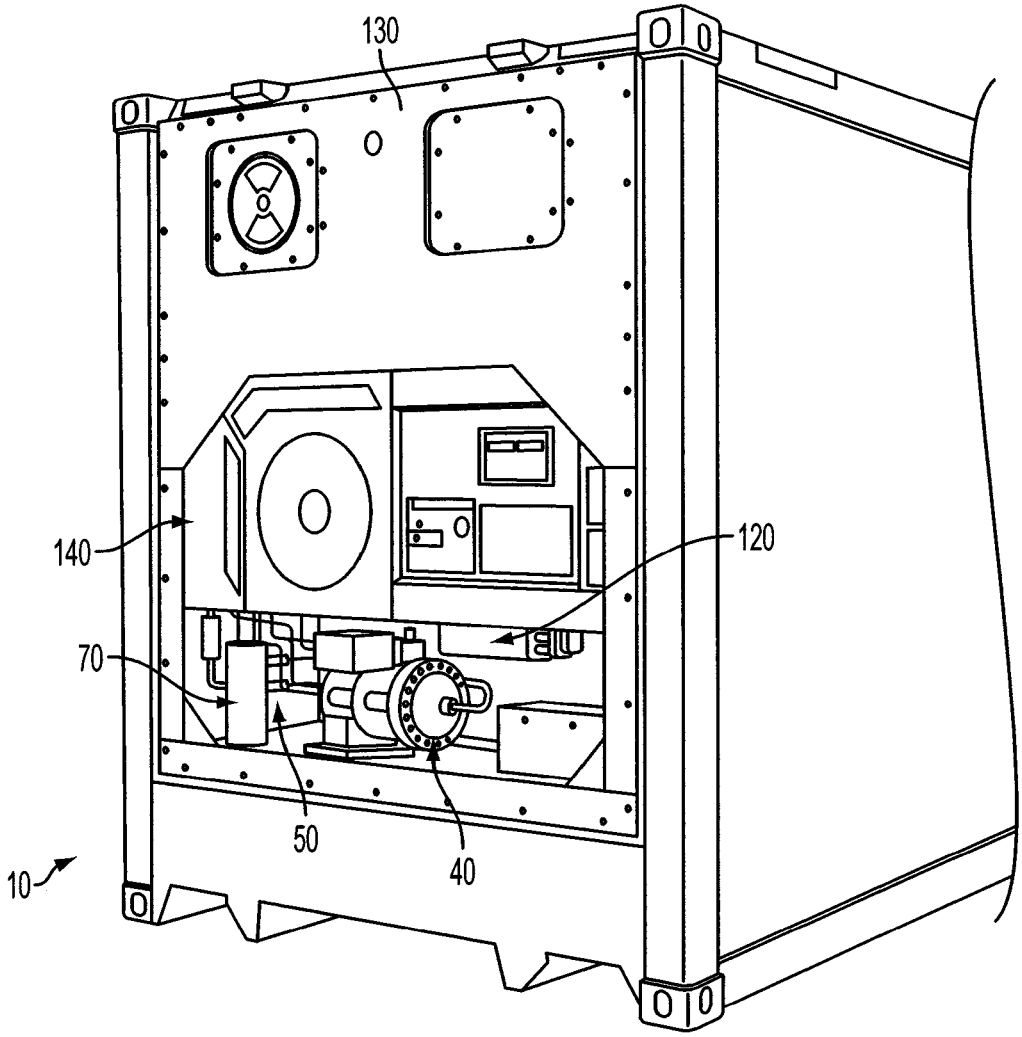
FIG. 2 is a perspective view of a container refrigeration unit incorporating the vapor compression cycle unit of FIG. 1.

With reference to FIGS. 1 and 2, a container refrigeration unit 10 is provided. The container refrigeration unit 10 incorporates a vapor compression cycle unit 12. The vapor compression cycle unit 12 includes an evaporator 20, an air-cooled heat rejection heat exchanger 30 and a compressor 40. The compressor 40 is operably disposed between the evaporator 20 and the air-cooled heat rejection heat exchanger 30. Both the evaporator 20 and the air-cooled heat rejection heat exchanger 30 may have typical configurations whereby respective fans blow air over respective heat exchange surfaces or coils for heat transfer communication, while the refrigerant fluid is flown inside the tubes or coils referenced hereabove.

The vapor compression cycle unit 12 may further include a heat rejection heat exchanger 13, such as a water-cooled brazed plate heat rejection heat exchanger 50. The water-cooled brazed plate heat rejection heat exchanger 50 is operably disposed between the compressor 40 and the evaporator 20 and is configured to be in fluid communication with the air-cooled heat rejection heat exchanger 30 and sources of high temperature fluid (e.g. compressor) and low temperature fluid (e.g. water tank), respectively. Within the water-cooled brazed plate heat rejection heat exchanger 50, the high temperature fluid is cooled via thermal communication with the low temperature fluid and the cooled high temperature fluid is then flown from the water-cooled brazed plate heat rejection heat exchanger 50 toward the evaporator 20. As will be described below with reference to FIG. 3 and 4, the water-cooled brazed plate heat rejection heat exchanger 50 is formed to define high and low temperature fluid pathways 501 and 502 and includes a plurality of brazed formations 503 to isolate the high temperature fluid pathway 501 from the low temperature fluid pathway 502.

The high temperature fluid is flown from the high temperature fluid source (typically compressor) to the air-cooled heat rejection heat exchanger 30 in thermal communication with ambient air, when an associate fan 140 is operational, through the water-cooled brazed plate heat rejection heat exchanger 50 in thermal communication with the low temperature fluid (when in operation) flown from the low temperature source (such as water tank) and then to the evaporator 20.

In accordance with embodiments, the high temperature fluid may include conventional refrigerants operating below the critical point and condensing during heat transfer interaction in the air-cooled heat rejection heat exchanger 30 and the water-cooled brazed plate heat rejection heat exchanger 50 (while in operation) or refrigerants, such carbon dioxide, operating below the critical point, at least for a portion of the time and above the critical point for another portion of the time, and the low temperature fluid may include water or glycol solutions. While operating above the critical point, refrigerant remains in a single phase. However, it is to be understood that other fluids and/or gases may be used interchangeably within the scope of the description provided herein.

As shown in FIG. 1, the compressor 40 may include at least a first stage compressor 41 and a second stage compressor 42 while the air-cooled heat rejection heat exchanger 30 may include a condenser/gas cooler 31, which is operably disposed downstream from the second stage compressor 42, and an intercooler 32. The intercooler 32 is operably disposed downstream from the first stage compressor 41. Compressed intermediate pressure refrigerant vapor from the first stage compressor 41 is flown to the intercooler 32 for first cooling communication and compressed high pressure refrigerant vapor from the second stage compressor 42 is flown to the condenser/gas cooler 31 for second cooling communication. As described above, the air-cooled heat rejection heat exchanger 30 may operate as a condenser when the refrigerant thermodynamic state is below the critical point and as a gas cooler when the refrigerant thermodynamic state is above the critical point.

The water-cooled brazed plate heat rejection heat exchanger 50 is operably disposed downstream from the condenser/gas cooler 31. Refrigerant leaving the condenser/gas cooler 31 is transmitted to the water-cooled brazed plate heat rejection heat exchanger 50 for further cooling operations therein, when each heat exchanger is actively engaged in the heat transfer interaction, with ambient air and a source of the cold fluid respectively. However, the condenser/gas cooler 31 and the water-cooled brazed plate heat rejection heat exchanger 50 can be used interchangeably depending on availability of the ambient air and cold fluid source. For instance, while onboard a ship, only a cold fluid source may be available, rendering only water-cooled brazed plate heat rejection heat exchanger 50 operational.

A secondary water-cooled brazed plate heat rejection heat exchanger 60 may be operably interposed between the intercooler 32 and the second stage compressor 42. Cooled refrigerant vapor from the intercooler 32 may be flown to the second stage compressor 42 passing through the secondary water-cooled brazed plate heat rejection heat exchanger 60 for further cooling communication therein. Similar to the condenser/gas cooler 31 and the water-cooled brazed plate heat rejection heat exchanger 50, intercooler 32 and secondary water-cooled brazed plate heat rejection heat exchanger 60 may operate simultaneously or alternately with one another depending on the low temperature source availability.

It also has to be understood that the water-cooled brazed plate heat rejection heat exchanger 50 and the secondary water-cooled brazed plate heat rejection heat exchanger 60 may both be disposed upstream of the condenser/gas cooler 31 and the intercooler 32, respectively. Further, the water-cooled brazed plate heat rejection heat exchanger 50 and the secondary water-cooled brazed plate heat rejection heat exchanger 60 may be two separate units, as depicted on FIG. 2, or they can be combined in a single unit, with four pairs of inlets/outlets, two for the cold fluid such as water or glycol solution and two for the hot fluid such as carbon dioxide or other refrigerant.

The vapor compression cycle unit 12 may further include a flash tank 70, a high pressure regulating valve 80, which is operably interposed between the water-cooled brazed plate heat rejection heat exchanger 50 and the flash tank 70, and an evaporator expansion valve 90. The evaporator expansion valve 90 is operably interposed between the flash tank 70 and the evaporator 20. The high pressure regulating valve 80 conveys the cooled high temperature fluid in the 2-phase thermodynamic state to the flash tank 70, which is configured to separate the gaseous phase from the liquid phase. Once the separation is complete, the flash tank 70 communicates the gaseous phase to the compressor 40 by way of a shutoff valve and check valve combination 95 and directs the liquid phase to the evaporator 20 via the evaporator expansion valve 90. The evaporator expansion valve 90 communicates the further expanded high temperature fluid in the 2-phase thermodynamic state to the evaporator 20. A probe 100, such as a pressure gage or a thermocouple, may be operably interposed between the high pressure regulating valve 80 and the flash tank 70.

The container refrigeration unit 10 and/or the vapor compression cycle unit 12 may further include a motor 110 to drive the compressor 40 and a variable frequency drive 120. The variable frequency drive 120 serves to actuate the motor 110 to drive the compressor 40 at varying speeds. In accordance with embodiments, the variable frequency drive 120 may be disposed at one or more of multiple positions including, but not limited to, a position #1 proximate to the evaporator 20, a central position #2, a position #3 proximate to the flash tank 70, a position #4 proximate to the secondary water-cooled brazed plate heat rejection heat exchanger 60, a position #5 proximate to the water-cooled brazed plate heat rejection heat exchanger 50 and an external position #6.

As shown in FIG. 2, the container refrigeration unit 10 includes a structural isolating frame 130 and the associate fan 140. The structural isolating frame 130 is formed to define an enclosure that encompasses and incorporates the vapor compression cycle unit 12. That is, the evaporator 20 is contained behind the structural isolating frame 130 and the air-cooled heat rejection heat exchanger 30 is contained behind the associate fan 140. The flash tank 70, the compressor 40 and the variable frequency drive 120 are disposed within the accessible portion of the enclosure, with the variable frequency drive 120 provided in the external position #6, for example. With this construction, space available for the water-cooled brazed plate heat rejection heat exchanger 50 is defined between the flash tank 70 and the compressor 40 and is thereby limited. Thus, the water-cooled brazed plate heat rejection heat exchanger 50 must be small enough to fit in the available space but still capable of providing for the necessary amount of heat transfer between the high and low temperature fluids. This is not generally possible with conventional container refrigeration units using shell and tube heat exchangers.

Figure 3:
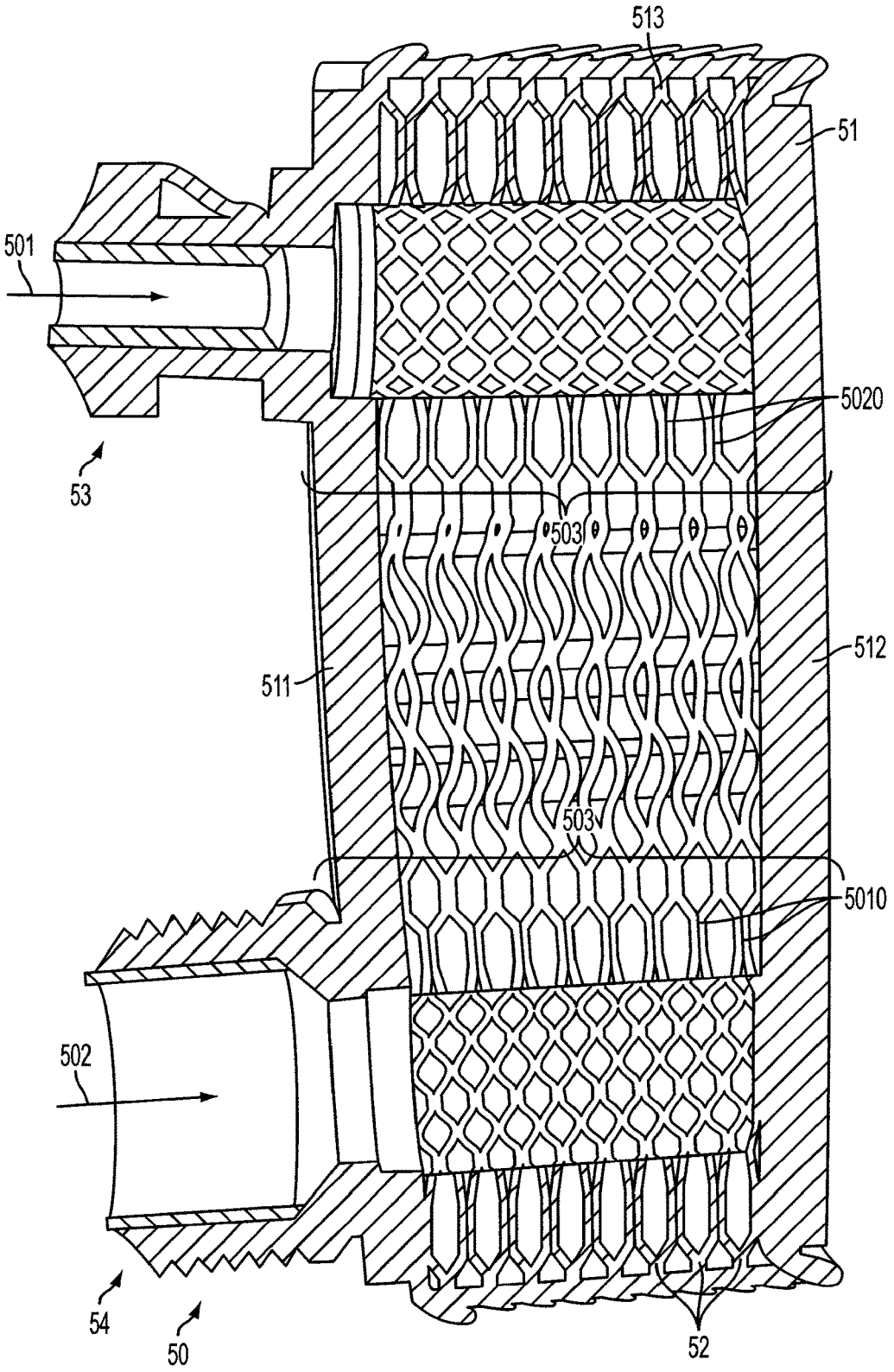
FIG. 3 and 4 are foreground and background cross sectional views, respectively, of a brazed plate water-cooled heat rejection heat exchanger for use within the spatial constraints of the container refrigeration unit of FIG. 2.
Figure 4:
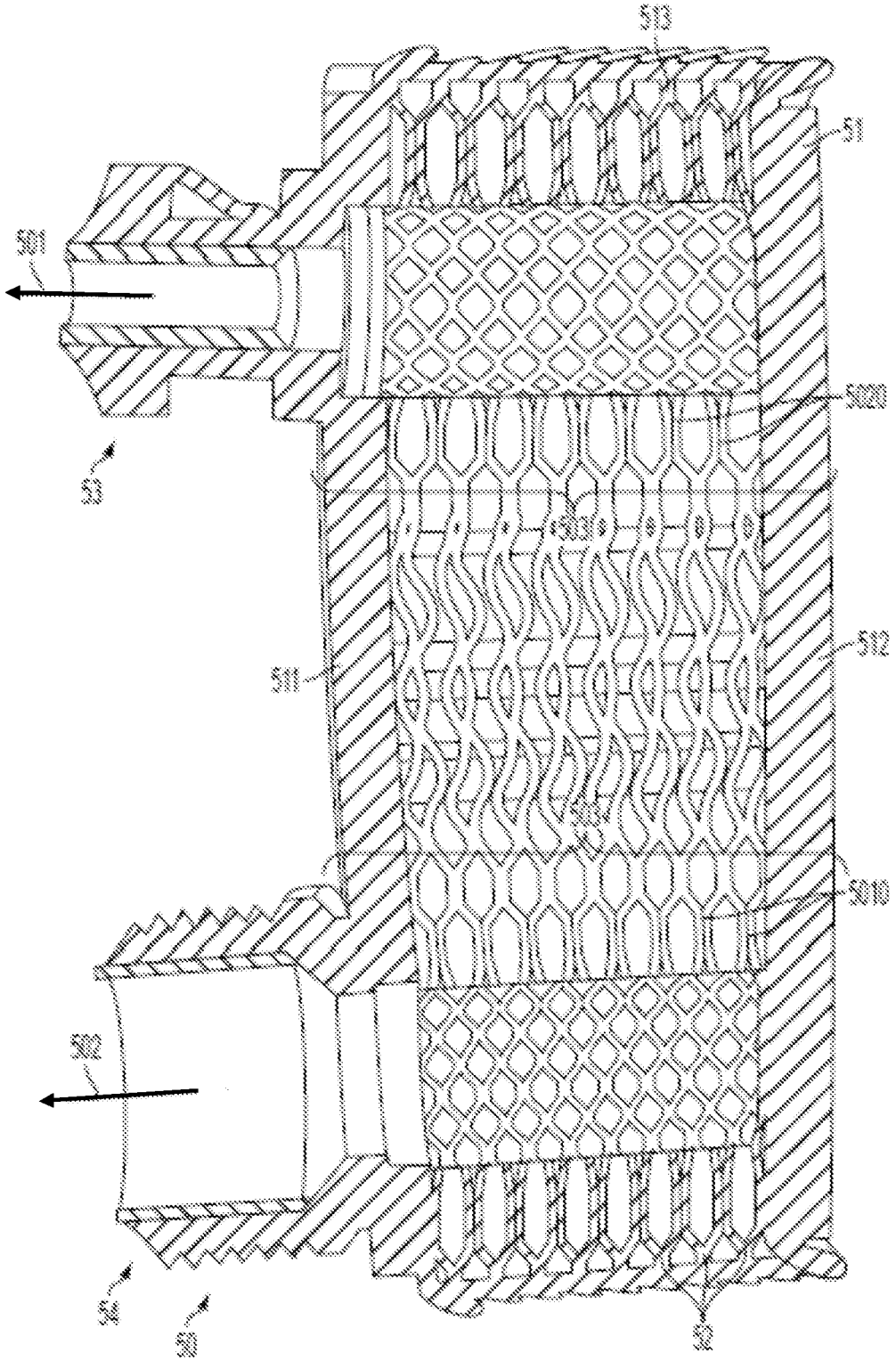

With reference to FIG. 3 and 4, the water-cooled brazed plate heat rejection heat exchanger 50 is shown as a water-cooled heat rejection heat exchanger that can operate as a gas cooler and/or condenser, as explained above in relation to the air-cooled heat rejection heat exchanger 30. As shown, the water-cooled brazed plate heat rejection heat exchanger 50 includes a housing 51 and a plurality of plates 52. The housing 51 has first and second opposing end plates 511 and 512 and sidewalls 513 formed from the ends of plates 52. The sidewalls 513 extend between the first and second opposing end plates 511 and 512 to form an enclosure. The first end plate 511 includes a first inlet/outlet pair 53 for the first or high temperature fluid (i.e., carbon dioxide or other refrigerant) and a second inlet/outlet pair 54 for the second or low temperature fluid (i.e., water or glycol solution).

The plurality of plates 52 along with the other components of the water-cooled brazed plate heat rejection heat exchanger 50 are typically formed of stainless steel or another similar material. The plurality of plates 52 is disposed within the enclosure formed between the first and second end plates 511 and 512 to define the high and low temperature fluid pathways 501 and 502 with the high temperature fluid pathway 501 being disposed in fluid communication with the first inlet/outlet pair 53 and the low temperature fluid pathway 502 being disposed in fluid communication with the second inlet/outlet pair 54. The plurality of brazed formations 503 is formed between adjacent ones of the first end plate 511, the plurality of plates 52 and the second end plate 512 to isolate the first fluid pathway 501 from the second fluid pathway 502 and vice versa.

In accordance with embodiments and, as shown in FIG. 3 and 4, the high temperature fluid enters the inlet of the first inlet/outlet pair 53 and is permitted to flow into the high temperature fluid pathway 501 but prevented from flowing into the low temperature fluid pathway 502 by brazed joints 5020. By contrast, the low temperature fluid enters the inlet of the second inlet/outlet pair 54 and is permitted to flow into the low temperature fluid pathway 502 but prevented from flowing into the high temperature fluid pathway 501 by brazed joints 5010. In accordance with further embodiments, the brazed joints 5010 and 5020 cooperatively form a honeycomb pattern or another similar pattern. It has to be understood that each of the inlet and outlet connections for the high temperature fluid and for the low temperature fluid may be located on either side of the water-cooled brazed plate heat rejection heat exchanger 50, and all these configurations are within the scope of the invention. Also, the water-cooled brazed plate heat rejection heat exchanger 50 may be oriented, vertically, horizontally, positioned on its side or at any inclination angle.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A refrigeration unit, comprising:

a vapor compression cycle unit including an evaporator, an air-cooled heat rejection heat exchanger and a compressor; and a water-cooled brazed plate heat rejection heat exchanger operably disposed between the compressor and the evaporator receiving high temperature fluid from the compressor and low temperature fluid from an external source, whereby the high temperature fluid is cooled via thermal communication with the low temperature fluid and is flown from the compressor to the evaporator, the water-cooled brazed plate heat rejection heat exchanger being formed to define high and low temperature fluid pathways and including first and second pluralities of brazed joint formations to prevent fluid entering the high temperature fluid pathway at a high temperature side of the water-cooled brazed plate heat rejection heat exchanger from flowing into the low temperature fluid pathway at a low temperature side of the water-cooled brazed plate heat rejection heat exchanger and vice versa, wherein:

the compressor comprises at least first and second compression stage compressors, and the air-cooled heat rejection heat exchanger comprises an air-cooled gas cooler/condenser operably disposed downstream from the second stage compressor and an air-cooled intercooler abutting the air-cooled gas cooler/condenser in an airflow and operably disposed downstream from the first stage compressor, the water-cooled brazed plate heat rejection heat exchanger comprises a primary water-cooled braze plate heat rejection heat exchanger positioned downstream from the second stage compressor and directly downstream from the air-cooled gas cooler/condenser and a secondary water-cooled braze plate heat rejection heat exchanger, which is separate from the primary water-cooled brazed plate heat rejection heat exchanger and positioned downstream from the first stage compressor and directly downstream from the air-cooled intercooler.

2. The refrigeration unit according to claim 1, wherein the high and low temperature pathways provide different cross-sectional areas for the high and low temperature fluids.

3. The refrigeration unit according to claim 1, wherein the high temperature fluid comprises carbon dioxide and the low temperature fluid comprises water.

4. The refrigeration unit according to claim 1, further comprising:

a flash tank;

a high pressure regulating valve operably interposed between the primary water-cooled brazed plate heat rejection heat exchanger and the flash tank; and an evaporator expansion valve operably interposed between the flash tank and the evaporator.

5. The refrigeration unit according to claim 4, wherein the flash tank separates cooled gaseous high temperature fluid from liquid high temperature fluid, delivers the gaseous high temperature fluid to the compressor and delivers the liquid high temperature fluid toward the evaporator via the evaporator expansion valve.

6. The refrigeration unit according to claim 1, wherein the vapor compression cycle unit comprises:

a motor to drive the compressor; and a variable frequency drive to actuate the motor to drive the compressor at varying speeds, the variable frequency drive being disposed at one of multiple positions.

7. A refrigeration unit, comprising:

a vapor compression cycle unit including an evaporator, an air-cooled heat rejection heat exchanger comprising an air-cooled gas cooler/condenser and an air-cooled intercooler abutting the air cooled gas cooler/condenser in an airflow and a compressor comprising first and second stages; and separate primary and secondary water-cooled brazed plate heat rejection heat exchangers respectively disposed on opposite sides of the air-cooled heat rejection heat exchanger and each comprising:

a housing having first and second opposing end plates and sidewalls extending between the end plates to form an enclosure, at least the first end plate including first and second inlet/outlet pairs for first and second fluids, respectively;

a plurality of plates disposed within the enclosure between the first and second end plates to define a first fluid pathway disposed in fluid communication with the first inlet/outlet pair and a second fluid pathway disposed in fluid communication with the second inlet/outlet pair; and first and second pluralities of brazed joint formations disposed between adjacent ones of the first end plate, the plurality of plates and the second end plate to isolate the first fluid pathway from the second fluid pathway, the primary water-cooled brazed plate heat rejection heat exchanger being positioned downstream from the second stage of the compressor and directly downstream from the air-cooled gas cooler/condenser, the secondary water-cooled braze plate heat rejection heat exchanger being positioned downstream from the first stage of the compressor and directly downstream from the air-cooled intercooler, the separate primary and secondary water-cooled brazed plate heat rejection heat exchangers receiving high temperature fluid from the compressor and low temperature fluid from an external source, whereby the high temperature fluid is cooled via thermal communication with the low temperature fluid and is flown from the compressor to the evaporator, and the separate primary and secondary water-cooled brazed plate heat rejection heat exchangers being formed to define the first and second fluid pathways as high and low temperature fluid pathways and the first and second pluralities of brazed joint formations to prevent fluid entering the high temperature fluid pathway at a high temperature side of the water-cooled brazed plate heat rejection heat exchanger from flowing into the low temperature fluid pathway at a low temperature side of the water-cooled brazed plate heat rejection heat exchanger and vice versa.

8. The refrigeration unit according to claim 7, wherein the inlet/outlet pairs for the first and second fluids and the pathways provide different cross-sectional areas for the first fluid and the second fluid.

9. The refrigeration unit according to claim 7, wherein the plurality of plates are fabricated from stainless steel.

10. The refrigeration unit according to claim 7, wherein the first fluid and the second fluid thermally communicate.

11. The refrigeration unit according to claim 7, wherein the first fluid comprises water and the second fluid comprises carbon dioxide.

12. The refrigeration unit according to claim 7, wherein the inlet/outlet pair for the first fluid is located on a same end plate as the inlet/outlet pair for the second fluid.

13. The refrigeration unit according to claim 7, wherein the inlet and outlet for at least one of the first fluid and the second fluid are located on opposite ends of the separate primary and secondary water-cooled brazed plate heat rejection heat exchanger.

14. A refrigeration unit, comprising:

a vapor compression cycle unit including an evaporator, an air-cooled heat rejection heat exchanger comprising an air-cooled gas cooler/condenser and an air-cooled intercooler abutting the air cooled gas cooler/condenser in an airflow and a compressor operably disposed between the evaporator and the condenser; and separate primary and secondary water-cooled brazed plate heat rejection heat exchangers respectively disposed directly downstream from the air-cooled gas cooler/condenser and the air-cooled intercooler and each comprising:

a housing having first and second opposing end plates and sidewalls extending between the end plates to form an enclosure, at least the first end plate including high and low temperature inlet/outlet pairs for high and low temperature fluids, respectively;

a plurality of plates disposed within the enclosure between the first and second end plates to define a high temperature fluid pathway disposed in fluid communication with the high temperature inlet/outlet pair and a low temperature fluid pathway disposed in fluid communication with the low temperature inlet/outlet pair; and first and second pluralities of brazed joint formations disposed between adjacent ones of the first end plate, the plurality of plates and the second end plate to prevent fluid entering the high temperature fluid pathway at a high temperature side of the separate primary and secondary water-cooled brazed plate heat rejection heat exchanger from flowing into the low temperature fluid pathway at a low temperature side of the water-cooled brazed plate heat rejection heat exchanger and vice versa.

15. The refrigeration unit according to claim 14, wherein the inlet/outlet pairs for the high and low temperature fluids and the pathways are providing different cross-sectional areas for the first fluid and the second fluid.

16. The refrigeration unit according to claim 14, wherein the plurality of plates are fabricated from stainless steel.

17. The refrigeration unit according to claim 14, wherein the high temperature fluid comprises carbon dioxide and the low temperature fluid comprises water.

18. The refrigeration unit according to claim 14, wherein the inlet/outlet pair for the high temperature fluid is located on a same end plate as the inlet/outlet pair for the low temperature fluid.

19. The refrigeration unit according to claim 14, wherein the inlet and outlet for at least one of the high temperature fluid and the low temperature fluid are located on opposite ends of the water-cooled brazed plate heat rejection heat exchanger.

* * * * *